US006454872B1

(12) United States Patent
Miller et al.

(10) Patent No.: US 6,454,872 B1
(45) Date of Patent: Sep. 24, 2002

(54) DISHWASHER WITH FOOD PARTICLE CHOPPING ASSEMBLY

(75) Inventors: Claude W. Miller, Troy, OH (US); Geoffrey L. Dingler, St. Joseph, MI (US); Todd M. Jozwiak, Benton Harbor, MI (US); John A. Miller, Stevensville, MI (US); Nicholas J. Cottrell, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 09/542,751

(22) Filed: Apr. 4, 2000

Related U.S. Application Data

(63) Continuation-in-part of application No. 09/326,303, filed on Jun. 4, 1999.

(51) Int. Cl.[7] ..... B08B 3/02

(52) U.S. Cl. ..... 134/10; 134/104.1; 134/115 D; 134/201; 134/104.4; 134/25.2; 241/46.012

(58) Field of Search ..... 134/104.1, 104.4, 134/115 D, 201, 10, 25.2; 241/46.012

(56) References Cited

U.S. PATENT DOCUMENTS

| | | | | | |
|---|---|---|---|---|---|
| 2,286,520 | A | * | 6/1942 | Tranberger | 134/115 G |
| 2,421,064 | A | * | 5/1947 | Hilliker | 134/115 G |
| 2,729,219 | A | * | 1/1956 | Smith, Jr. | 134/115 G |
| 3,025,864 | A | * | 3/1962 | Ensign | 134/115 G |
| 3,129,711 | A | * | 4/1964 | Matzen | 134/115 G |
| 3,356,097 | A | * | 12/1967 | Schaap | 134/115 G |
| 3,370,598 | A | * | 2/1968 | Lopp et al. | 134/115 G |
| 3,434,671 | A | | 3/1969 | Cushing et al. | 241/46 |
| 3,591,095 | A | * | 7/1971 | Distefano | |
| 3,653,807 | A | * | 4/1972 | Platt | 134/115 G |
| 3,981,456 | A | | 9/1976 | Hahn et al. | 241/46 |
| 4,201,345 | A | | 5/1980 | Ziegler | 241/46 |
| 4,228,962 | A | * | 10/1980 | Dingler et al. | |
| 4,350,306 | A | | 9/1982 | Dingler et al. | 241/46.15 |
| 4,448,359 | A | | 5/1984 | Meyers | 241/46.06 |
| 4,795,102 | A | | 1/1989 | Jordan et al. | 241/46 R |
| 4,822,241 | A | * | 4/1989 | Jarvis et al. | |
| 5,143,306 | A | * | 9/1992 | Nilsson | |
| 5,377,707 | A | * | 1/1995 | Young, Jr. | |
| 5,628,334 | A | | 5/1997 | Edwards et al. | 134/104.1 |
| 5,700,329 | A | * | 12/1997 | Edwards et al. | |
| 5,762,080 | A | * | 6/1998 | Edwards et al. | |
| 5,909,743 | A | * | 6/1999 | Thies et al. | |

FOREIGN PATENT DOCUMENTS

| | | | | |
|---|---|---|---|---|
| GB | 814417 | * | 6/1959 | 134/115 G |
| JP | 10-33448 | * | 10/1998 | |

OTHER PUBLICATIONS

European Patent Application (EPO) 913,119 Oct. 1997.*

* cited by examiner

*Primary Examiner*—Frankie L. Stinson
(74) *Attorney, Agent, or Firm*—Robert O. Rice; Joel Van Winkle; Stephen D. Krefman

(57) ABSTRACT

The present invention provides a dishwasher having a wash chamber including a sump. A pump having a rotating element is supported within a pump housing wherein the pump is adapted to draw liquid from the sump through an inlet area and then pump liquid to the wash chamber. A particle chopping assembly is supported in the inlet area upstream of the rotating element, the particle sizing assembly including a particle screen rotatably supporting drive shaft which drivingly supports a chopping blade adjacent the particle screen. The drive shaft has a coupling end which detachably couples to the rotating element. The coupling between the chopping blade and the rotating element is capable of accommodating axial tolerance with regard to the axial position of the rotating element.

24 Claims, 6 Drawing Sheets

DISHWASHER WITH FOOD PARTICLE CHOPPING ASSEMBLY

This is a continuation-in-part of application Ser. No. 09/326,303, entitled "WASH LIQUID CIRCULATION SYSTEM FOR A DISHWASHER", filed on Jun. 4, 1999 and still pending.

BACKGROUND OF THE INVENTION

1. Field of the Invention

This invention relates generally to the field of dishwasher pumps and more particularly to a pump having an improved particle chopper system.

2. Description of the Related Art

It is well know to provide a dishwasher with a rotating blade or cutter for chopping or sizing relatively large food particles into smaller particles. A typical dishwasher chopping system is disclosed by Cushing et al, in U.S. Pat. No. 3,434,671, issued Mar. 25, 1969. This patent teaches macerating means for a dishwashing pump having a single blade extending outward along a generally radial line and having a connection to the drive shaft of the drive motor. The blade, which includes a cutting edge, is closely spaced from a grid-like grading element at the pump inlet and is operable for macerating or chopping food particles. The blade is attached to the shaft of the drive motor for rotation therewith.

Hahn et al, in U.S. Pat. No. 3,981,456 issued Sep. 21, 1976, and Ziegler, in U.S. Pat. No. 4,201,345 issued May 6, 1980, each disclose a cutter formed from wire and attached to the shaft of the drive motor for rotation thereby. The wire cutter is rotated adjacent a grading element or screen having grid-like openings for effecting the maceration or chopping of food particles.

Dingier et al, in U.S. Pat. No. 4,350,306 issued Sept. 21, 1982, teach a combination recirculating and drain pump construction with a soft food disposer having a chopper blade. The chopper blade is mounted to a wash impeller and is supported immediately upstream and adjacent to a filter screen. The chopper blade along with the wash impeller is secured to a motor drive shaft via a threaded fastener.

Jordan et al., in U.S. Pat. No. 4,795,102, issued May 15, 1984, discloses a dishwasher pump which includes a particle cutter for cutting food particles. The particle cutter is positively secured or mounted to a drain pump impeller and is supported adjacent square apertures provided in a chopper disc or plate. The drain pump is secured to a pump drive shaft. Food particles are chopped by the particle cutter and pass through the apertures into the drain pump so that they may be pumped by the drain pump to an external drain.

The prior art has thus shown a number of different cutters usable with dishwasher pumps to effect comminution or chopping of food and other particles carried by the dishwashing liquid. All of the prior art dishwasher chopping system disclose show a chopping blade which is supported and securely attached to a rotation drive shaft or a rotating element secured to the drive shaft.

SUMMARY OF THE INVENTION

The present invention provides a dishwasher having a wash chamber including a sump. A pump having a rotating element is supported within a pump housing wherein the pump is adapted to draw liquid from the sump through an inlet area and then pump liquid to the wash chamber. A particle chopping assembly is supported in the inlet area upstream of the rotating element, the particle sizing assembly including a particle screen rotatably supporting a chopping blade. The chopping blade is detachably coupled to the rotating element for co-rotation therewith.

The particle chopping assembly may further include a drive shaft which is rotatably supported on the particle screen and which drivingly supports the chopping blade. The drive shaft has a coupling end which detachably couples to the rotating element. The coupling between the chopping blade and the rotating element is capable of accommodating axial tolerance with regard to the axial position of the rotating element.

The present invention further is directed to a method for assembling a dishwasher which includes a sump. The method of assembly includes assembling a chopping assembly including a particle screen, a drive shaft and a chopping blade wherein the drive shaft driving supports the chopping blade and is rotatably secured to the particle screen. The chopping assembly is secured within the sump. A pump assembly including a motor and impeller is connected to the sump such that a drive extension of the impeller is drivingly coupled to the chopping assembly. Alternatively, the pump assembly may be connected to the sump before the chopping assembly.

DESCRIPTION OF THE PREFERRED EMBODIMENTS

Figure 1:
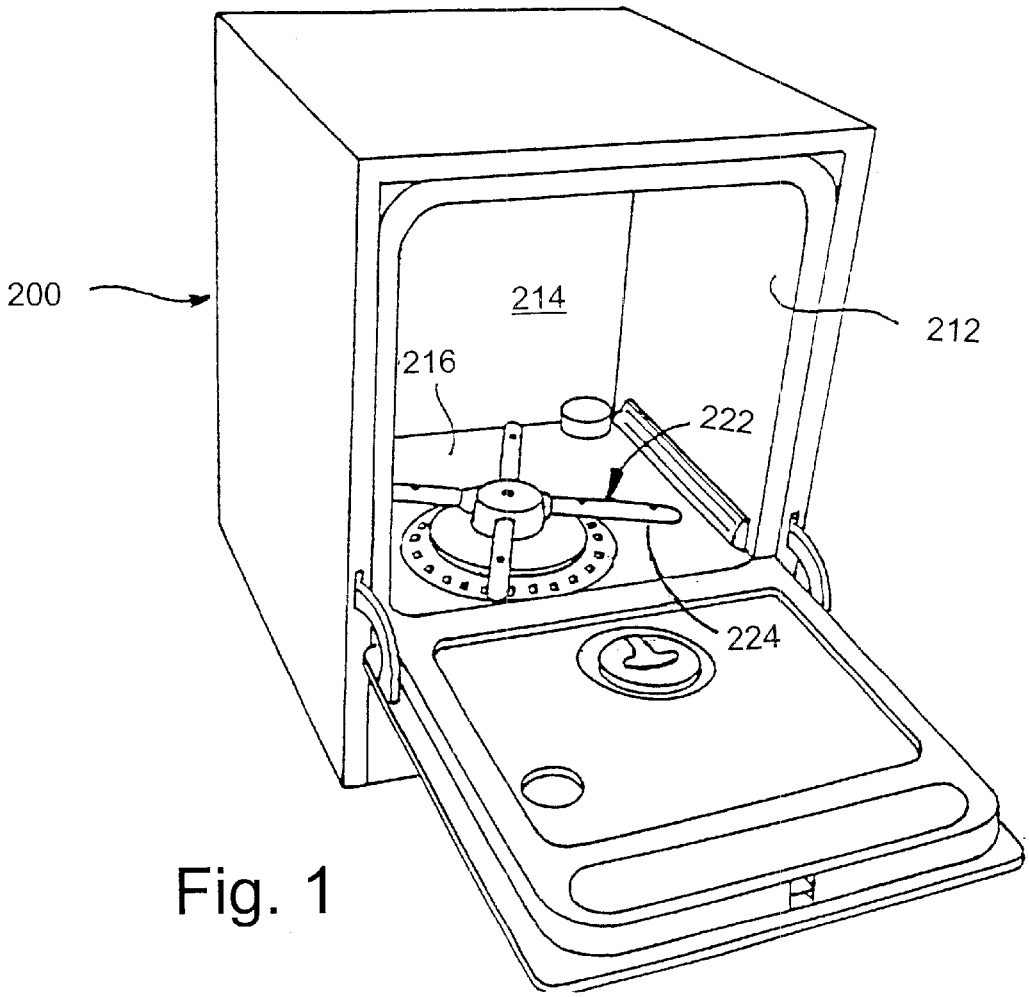
FIG. 1 is a perspective view of a dishwasher in accordance with the present invention.
Figure 2:
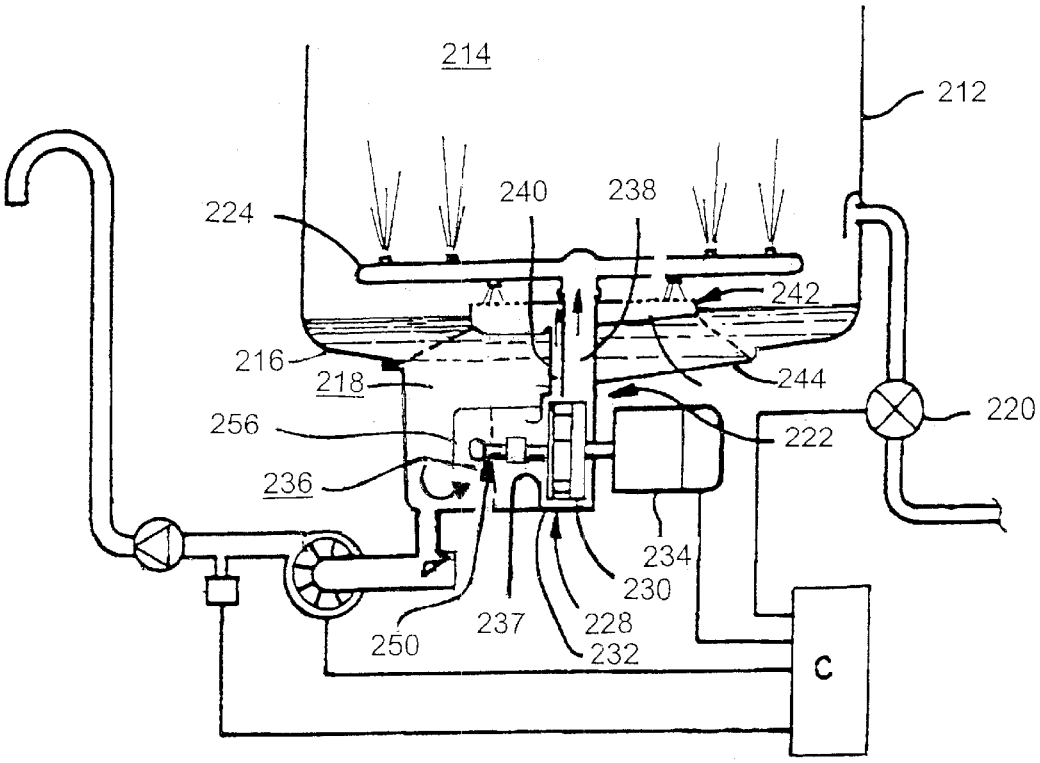
FIG. 2 is a schematic illustration of the lower area of the dishwasher shown in FIG. 1, including the sump and the wash pump of the present invention.

In accordance with the invention as shown in the drawings, and particularly as shown in FIGS. 1 and 2, an automatic dishwasher generally designated 200 includes an interior tub 212 forming an interior wash chamber or dishwashing space 214. The wash tub 212 includes a bottom wall 216 having a downwardly sloped portion which defines a lower tub region or sump 218 for receiving wash liquid inlet into the tub 212 through a fill valve 220. A soil separator and pump assembly 222 is located in the sump 218 for recirculating wash liquid from the sump 218 through the tub 212. A wash arm assembly 224 is provided above the pump assembly 222 and receives wash liquid from the pump system 222.

The soil separator/pump assembly 222 includes a pump 228. The pump 228 is a centrifugal pump having a wash impeller 230 rotated about a horizontal axis within a pump chamber 232 which defines a spiral casing. During a wash cycle, the wash impeller 230, driven by motor 234, draws wash liquid from the sump 218 through a pump inlet area 236 including an inlet opening 237 and pumps the wash liquid out through a main outlet 238 and a secondary outlet 240. Wash liquid pumped through the main pump outlet 238 is directed to flow into the lower spray arm 224. Wash liquid flowing through the secondary outlet is directed to flow into a soil collector 242. Wash liquid is repeatedly recirculated throughout the wash tub 212 for removing soils from dishware supported therein.

It can be understood that at least a portion of the sump 218 may be formed by a bottom member 244 which form part of the tub bottom 216 defining the sump 218. The bottom member 244 may also be used to help defined the pump chamber 232, the pump inlet area 236, the main outlet 238 and the secondary, outlet 240. While this structure is shown as a particular embodiment of the invention, it is clearly just one example of how the present invention may be practiced. The sump tub bottom chamber and pump inlet area may be formed in any of a plurality of known ways such as shown in U.S. Pat. Nos. 3,434,671 and 5,628,334, described above.

Figure 3:
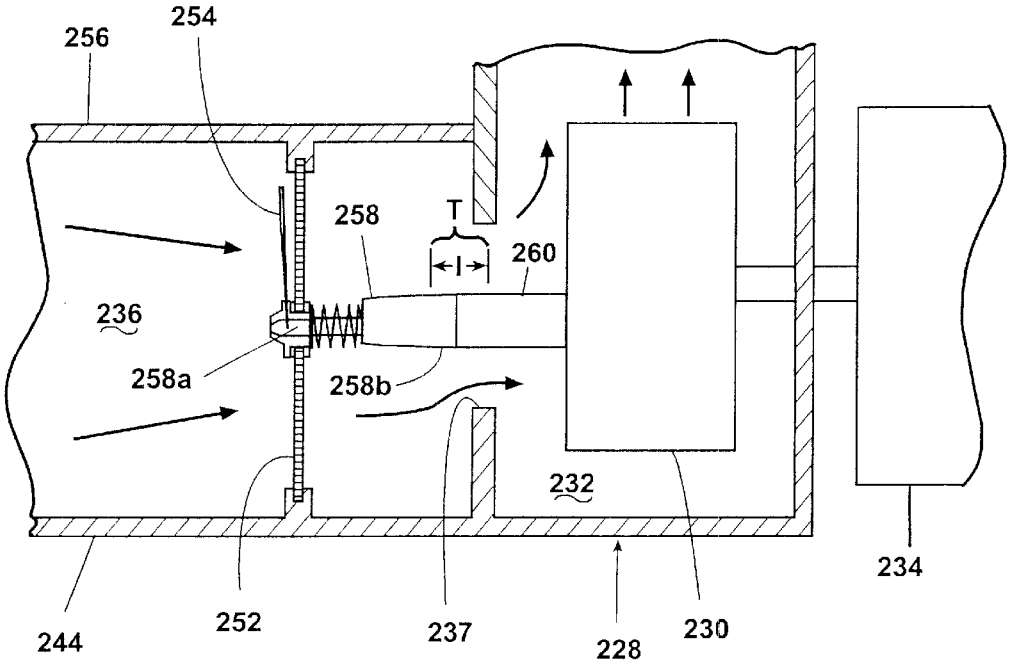
FIG. 3 is a sectional view of the pump and pump inlet area, illustrating the soil chopping system of the present invention and the coupling of the chopping system to the pump.

According to the present invention, wash liquid drawn into through the pump inlet area 236 passes through a particle chopping assembly 250, as shown in FIG. 3. The chopping or chopper assembly 250 includes a sizing plate or screen 252 and a chopping or chopper blade 254. The chopper blade 254 rotates adjacent the sizing plate 252 and chops food particles entrained within the wash liquid to size sufficient to allow the food particles to pass through the sizing plate 252. After being chopped and sized by the chopper assembly 250, the soils are drawn, along with the wash liquid, into the pump chamber 232.

The chopping assembly 250 is uniquely designed to be a separate subassembly from the impeller 230 such that the chopping assembly 250 may be located in the inlet area 236 independently of the wash impeller 230 and motor 234. This is accomplished by having the chopping blade 254 rotatably supported on the screen 252. In particular, the chopping blade 254 is mounted to a drive shaft 258 having a keyed first end **258*a* and a second end 258*b*. The drive shaft 258 is rotatably secured to the screen 252. In this way, by forming an independent chopping assembly 250, the distance between the blade 254 and the screen 252 can be closely controlled ensuring that the blade 254 is relatively close to the screen 252**.

It should be recognized by one skilled in the art that although the chopping assembly 250 of this embodiment and the below described second embodiment are shown located in an inlet area, the exact location of the chopping assembly is not critical and is not understood to be a limitation of the invention. Any location upstream from the wash impeller through which wash liquid flows can accommodate the chopping assembly of the present invention.

The screen 252 may be mounted within the inlet area 236 by, for example, trapping the screen 252 between an inlet shroud 256 which defines the inlet area 236, and a bottom wall formed by the bottom member 224. Alternatively, the screen 252 could be secured within the inlet area 236 in any known manner such as through the use of clips, threaded fasteners or using other known methods. Once the screen 252 is secured into the inlet area 236, the second end **258*b* of the drive shaft 258 extends toward the impeller 230**.

The second end **258*b* is designed to detachably couple with a drive extension 260 extending from the impeller 230. The coupling arrangement between the second end of the drive shaft 258*b* and the drive extension 260 is designed to accommodate the tolerance T in the end location of the drive extension 260. In this way, by using a coupling system capable of accommodating tolerance T, the chopping blade assembly 250 can be rotatably driven and the distance between the blade 254 and the screen 252 is not affected by the tolerance T. The detachable coupling system between the drive shaft 258 and the drive extension 260** may be any type of known coupling arrangement including using engaging teeth, using a shaft and spline arrangement insertable within a bore provided with a slot, or through other known coupling systems.

It can readily be appreciated that the chopping assembly 250 can connect directly to the impeller 230 through a drive extension 260 which is integrally formed as part of the impeller 230. Alternatively, the drive extension could be a separate element connected the impeller 230. Moreover, the motor drive shaft may be allowed to pass through the impeller 230 such that the chopping assembly detachably couples directly to the motor drive shaft. In each case, the chopping assembly 250 detachably couples to a rotating element.

Figure 4:
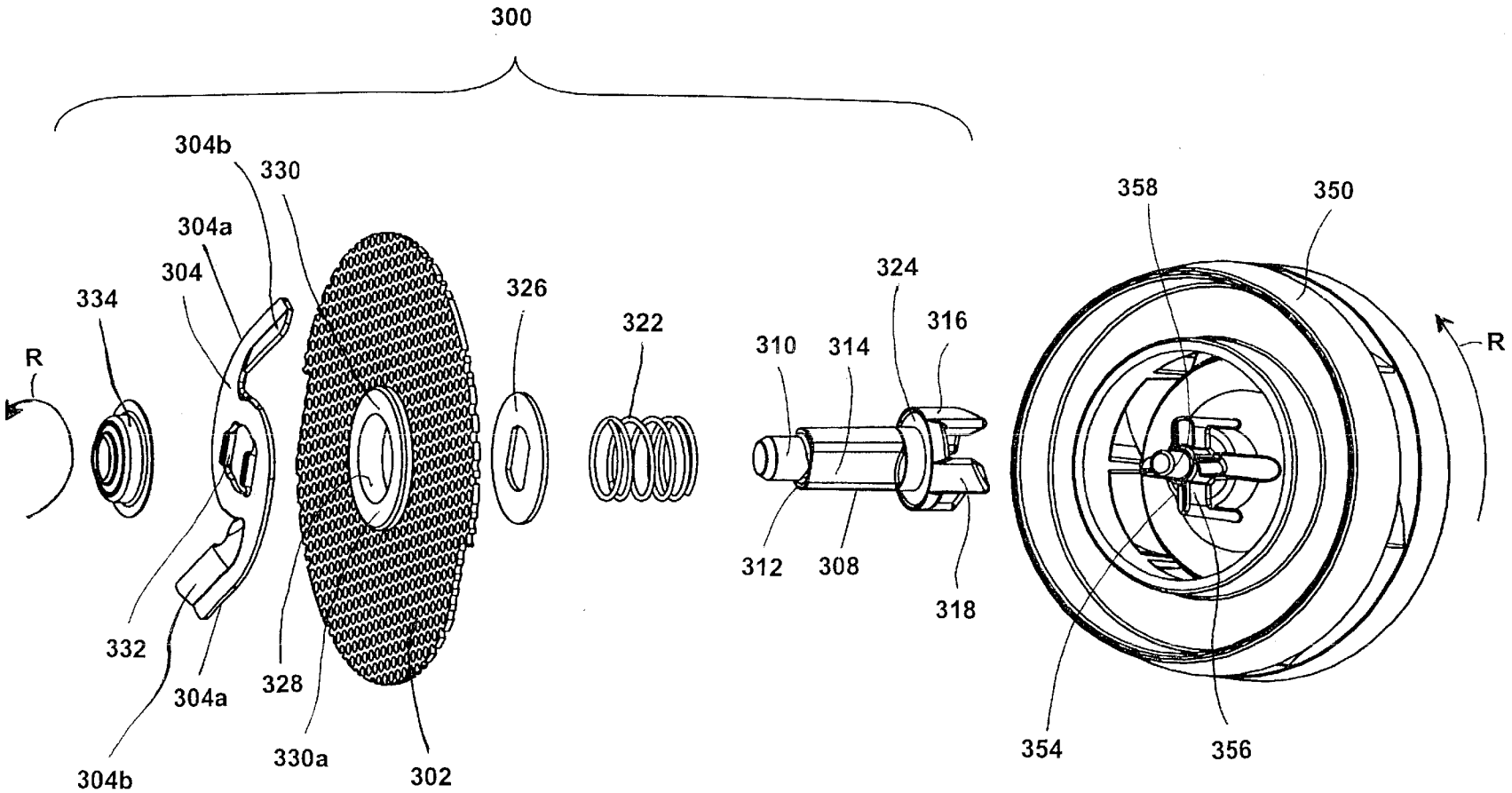
FIG. 4 is an exploded, perspective view of a second, more detailed embodiment of the soil chopping assembly of the present invention.
Figure 5:
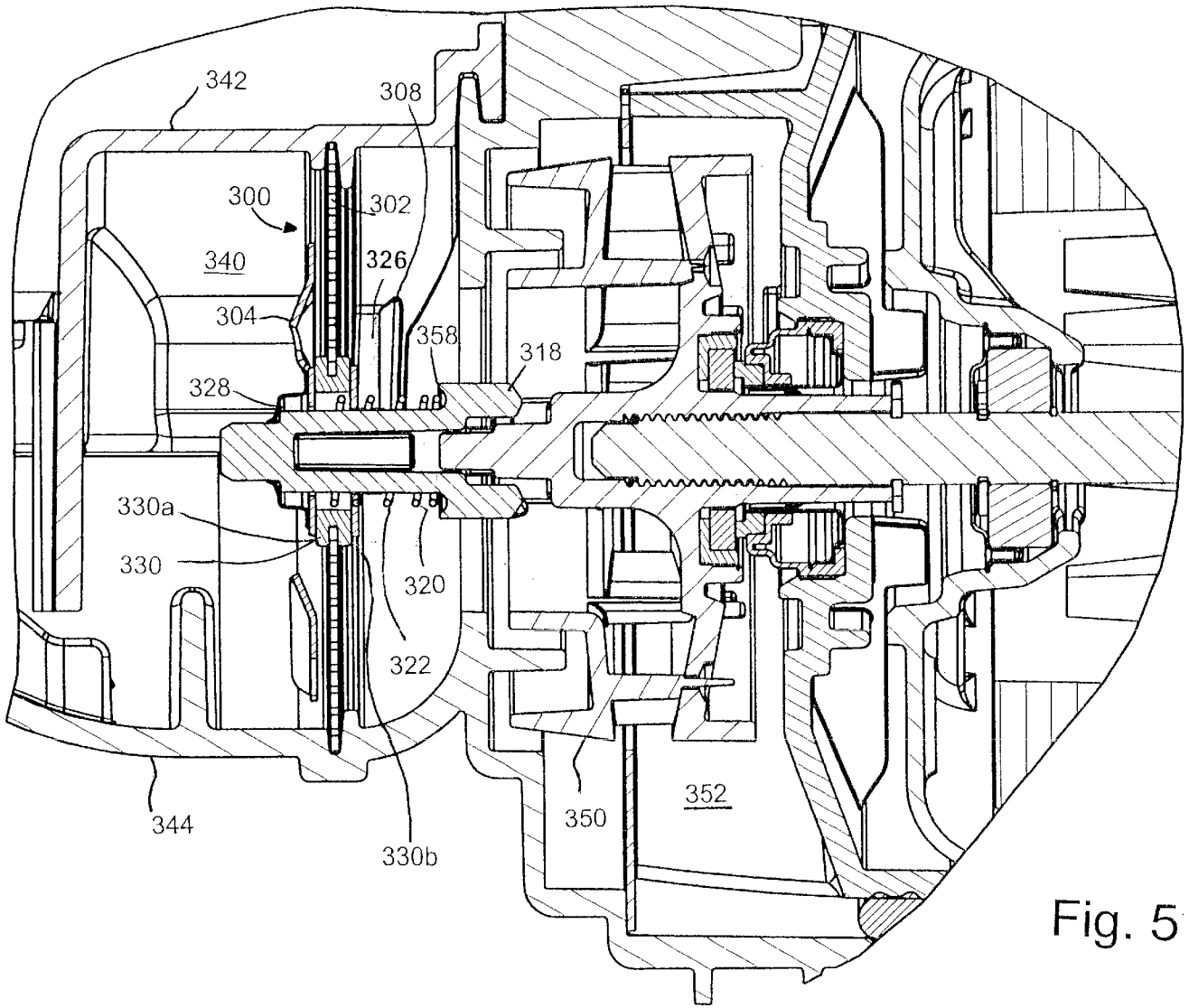
FIG. 5 is a sectional view of the second embodiment of the present invention, showing the soil chopping assembly assembled into the sump and coupled to the pump.
Figure 6:
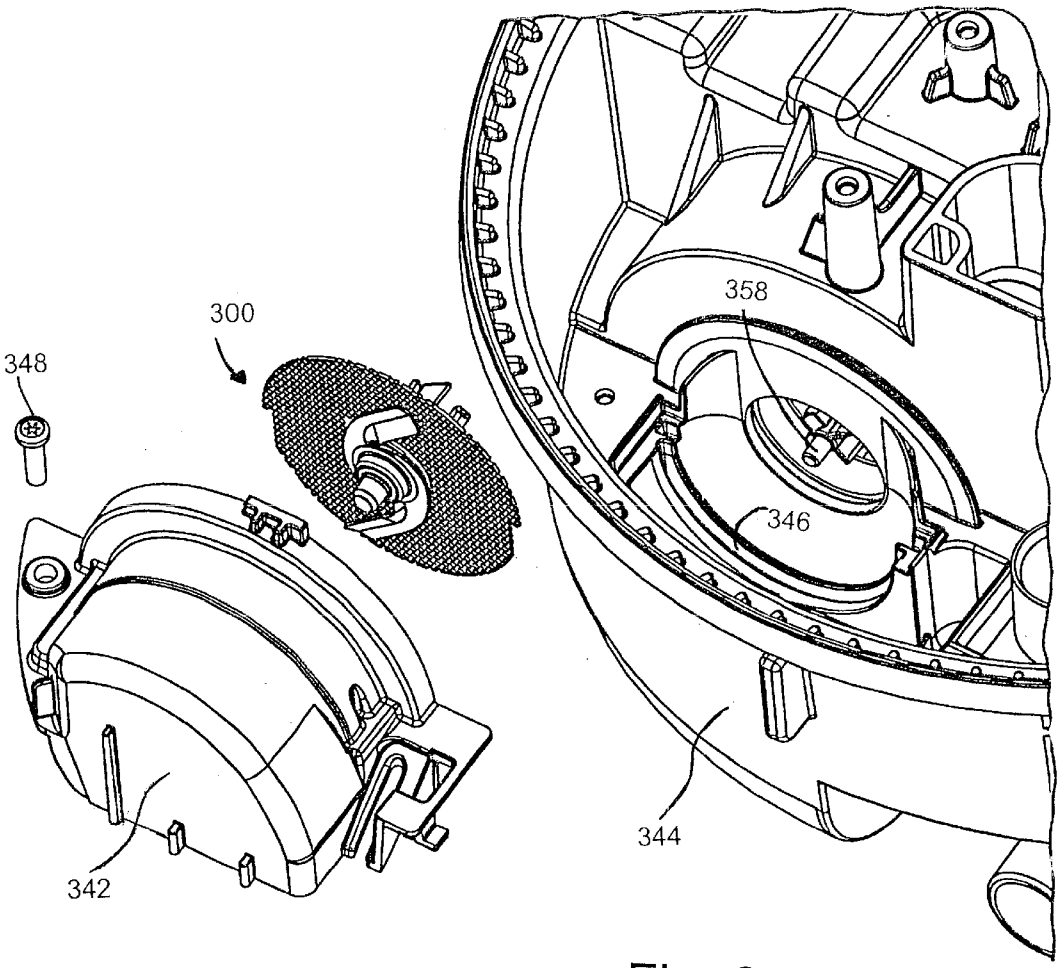
FIG. 6 is an exploded, perspective view of the second embodiment of the present invention, showing how the chopping assembly is assembled and secured into the inlet area of the sump.

Turning now to FIGS. 4–6, a second, more detailed embodiment of the present invention can be explained. In FIG. 4 there is shown a chopper or chopping assembly 300 which includes a screen 302, a chopping blade 304 and a drive shaft 308. The screen 302 includes a center opening 328 and a bearing 330 is provided about the center opening 328. The bearing 330 may be insert molded onto the screen 302 and may formed using a bearing material such as Rulon® made by Furon®. The bearing 330 includes a first bearing surface **330*a* and a second bearing surface 330*b* (FIG. 5). The drive shaft 308 has a first end which includes a cylindrical portion 310 which terminates in a shoulder 312. A middle section of the drive shaft 308 includes at least one flat 314. At a second end 316, opposite the first end, a coupling element is provided including a plurality of engagement teeth 318 and a centering hole 320 (see FIG. 5**).

In assembling the chopper assembly 300, a spring 322 is fit over the drive shaft 308 to seat on a second shoulder 324. A washer 326 is then inserted onto the drive shaft 308 and the drive shaft 308 is inserted through the center opening 328 in the screen 302. The chopping blade 304 is then inserted onto the drive shaft 308 such that flat 332 engages the flat 314 formed onto the drive shaft. A push nut fastener 334 is pressed onto the cylindrical end 310 of the drive shaft 308 and seats the center portion of the chopping blade 304 against the first bearing surface **330*a* and washer 326 against second bearing surface 330*b*. The fastener 334 secures the chopping assembly 300** together. While a push fastener is shown, any type of known and suitable fastener could be used.

After assembly, the chopping assembly 300 may be secured within an inlet area 340 of the dishwasher pump. The chopping assembly may be secured in the inlet area by capturing the chopping assembly 300 between an inlet shroud 342 and a bottom wall 344. As best seen in FIG. 6, the chopping assembly 300 may be initially located or secured into a groove or slot 346 provided in the bottom wall 344 and then the inlet shroud 342 may be attached to a bottom wall 344 through the use of a threaded fastener 348. The inlet shroud 342 may include a corresponding groove for engaging the screen 302 such that the chopping assembly is securely located. Alternatively, the chopping assembly 300 may be secured within the inlet area 340 in an known manner such as through the use of clips, threaded fasteners or using other known methods.

When positioned within the inlet area 340, the second end 316 of the drive shaft extends toward a rotating element or impeller 350 which is located within a pump chamber 352. The impeller operates to draw liquid through the inlet area 340 and into the pump chamber 352 whereupon liquid is pumped through a pump outlet (not shown). The impeller 350 includes a drive extension 354. The drive extension 354 includes a plurality of teeth or arms 356 and a center pin 358.

When the impeller 350 and the chopping assembly 300 are assembled into a dishwasher, the second end 316 and the drive extension 354 are detachably coupled. In particular, the center pin 358 is received into the centering hole 320 and the teeth 318 engage with the teeth 356 of the drive extension 354. The teeth 318 and 356 and the centering hole 320 and the center pin 358 are purposefully designed to overlap a sufficient distance such that the coupling arrangement is capable of accommodating axial tolerance—tolerance along the axis of rotation—with regard to the relative position of the drive extension 354.

It can be understood therefore, by one skilled in the art, that the axial position of the chopping blade 304 and the screen 302 relative to each other can be controlled independently of the position of the rotating element 350. Looking at FIG. 5, it can be seen that as the drive shaft 308 is rotated, the center portion of the blade 304 slides along the first bearing surface 330*a*. The bearing 330, therefore, controls the spacing between the blade 304 and the screen 302. Since the bearing can be formed with a relatively great degree of accuracy, the spacing between the blade 304 and the screen 302 can be closely controlled. For example, the clearance between the blade 304 and the screen 302 may be as little as 1.5 mm. This relatively small blade clearance promotes improved soil chopping or size reduction.

In addition to accommodating axial tolerance, the chopper assembly 300 is configured to accommodate radial tolerance with regard to the position of the rotating element 350 and drive extension 354. In particular, the center opening 328 of the bearing 330 is designed with a sufficient size to provide radial clearance for accommodating off center tolerance which may occur in the position of the drive extension 354 and the center of the center opening 328. Off center may be caused by tolerance in positioning the screen 302 and in positioning the drive extension 354 of the impeller 350. The chopper assembly 300 permits the drive shaft 308 to be axially positioned by the drive extension 354 and rotated in a off-center position with regard to the center opening 328.

An additional aspect of the invention is provided by the configuration of the chopping blade 304. The chopping blade 304 is driven by the motor 234 in direction R during the recirculating periods and is designed to chop or reduce the size of food particles as it rotates adjacent the screen 302. To that end, the chopping blade 304 includes a cutting surface 304*a*. One problem, however, that can occur when using a chopping assembly is that soils can pass by the chopping blade 304 and get stuck in the screen 302. Alternatively, some stringy type soils can fail to be properly reduced in sized and pass through the screen 302. To address this problem, the chopping blade 304 of the present invention includes one or more reverse angle surfaces or vanes 304*b*. These reverse angle surfaces 304*b* are configured to pump or lift liquid away from the screen 302 when the blade 304 is driven in direction R. The reverse angle surfaces 304 are actually pumping against the flow of wash liquid through the inlet area 340. In this manner, soils which collect on the sizing screen 302 are lifted off the screen for additional chopping by the rotating chopping blade 30.

The chopping efficiency of the present invention is therefore promoted by having the blade 304 close to the screen 302 and by having the blade 304 lift soils away from the screen as the blade rotates such that soils can be reduced in size. As can be understood by one skilled in the art, the improved chopping efficiency of the soil chopping assembly allows for a more efficient dishwasher that uses less water. In particular, relatively small screen holes can be used allowing for the use of relatively small spray nozzles on the wash arm 224. Smaller nozzle holes in the wash arm allow for the use of less water by the dishwasher.

The present invention provides for a unique and beneficial method of assembling a dishwasher. In particular, the method of assembling a dishwasher according to the present invention includes assembling the chopping assembly 300 including the particle screen 302, the drive shaft 308 and the chopping blade 304 wherein the drive shaft driving supports the chopping blade and is rotatably secured to the particle screen. As discussed above, this subassembly provides for the appropriate spacing between the blade 304 and the screen 302. The chopping assembly 300 can then be secured within the sump of the dishwasher. A pump assembly includes a motor and the impeller 350 may then be connected to the sump, wherein a drive extension of the impeller is drivingly coupled to the chopping assembly. Alternatively, the pump assembly may be connected to the sump and then the chopping assembly may be inserted into the sump.

The present invention, therefore, provides for a unique chopper assembly which forms a subassembly independent of the rotating or driving element. The unique chopper assembly is provided with a coupling arrangement which is capable of driving engagement with a rotating element and can accommodate axial tolerance of rotating element. The present invention further allows for unique manner of assembly a dishwasher and in particular the pump system of a dishwasher wherein the chopper assembly may be assembled into a dishwasher independently of the impeller/motor assembly.

The present disclosure describes preferred embodiments of the invention, however, the invention is not limited to these embodiments. Variations may be made from the described preferred embodiments which are contemplated to be within the spirit and scope of the invention as set forth in the appended claims.

What is claimed is:

1. A dishwasher, comprising:

a sump;

a pump housing forming a pumping chamber having an inlet in fluid communication with the sump and an outlet, a motor drive shaft extending into the pumping chamber;

an impeller connected to the motor drive shaft for rotation within the pumping chamber;

a particle screen supported upstream of the impeller; and a chopping blade and a drive shaft rotatably mounted on the particle screen, said drive shaft drivingly supporting the chopping blade and having a coupling end which detachably couples to the impeller.

2. The dishwasher according to claim 1, wherein the coupling between the chopping blade and the impeller is capable of accommodating axial tolerance between the coupling end of the drive shaft and the impeller.

3. The dishwasher according to claim 1, wherein the impeller includes a drive extension which detachably couples to the coupling end of the drive shaft.

4. The dishwasher according to claim 3, wherein the coupling end includes a plurality of teeth and the drive extension includes a plurality of teeth, the teeth of the coupling end and the teeth of the drive extension engaging each other to drivingly couple the drive shaft to the impeller, and the teeth of the coupling end and the teeth of the drive extension over lap each other to accommodate axial tolerance in the axial position of the impeller.

5. The dishwasher according to claim 1, further comprising:

the particle screen having a center opening provided with a bearing having a first bearing surface and an opposite second bearing surface, and a drive shaft rotatably supported on the particle screen, the drive shaft having a first end extending through the center opening of the particle screen wherein the chopping blade is mounted to the first end of the drive shaft and is biased against the first bearing surface, the drive shaft further having a coupling end which detachably couples to the impeller.

6. The dishwasher according to claim 1, further comprising:

the particle screen having a center opening provided with a bearing having a first bearing surface and an opposite second bearing surface, a drive shaft having a first end extending through the center opening of the particle screen, the drive shaft further having a coupling end including a shoulder, the coupling end detachably couples to the impeller;

a fastener for securing the chopping blade onto the first end of the drive shaft such that the chopping blade is drivingly supported on the drive shaft and seats on the first bearing surface;

a washer disposed about the drive shaft adjacent the second bearing surface; and a spring disposed about the drive shaft and captured between the shoulder and the washer such that chopping blade is biased toward the particle screen.

7. A dishwasher, comprising:

a sump;

a pump housing forming a pumping chamber having an inlet in fluid communication with the sump and an outlet, a motor drive shaft extending into the pumping chamber;

an impeller connected to the motor drive shaft for rotation within the pumping chamber;

a particle screen supported upstream of the impeller; and a chopping blade rotatably supported on the particle screen and detachably coupled to the impeller for co-rotation therewith, wherein the chopping blade further comprises a reverse angle portion which directs wash liquid upstream, away from the particle screen when the chopping blade is rotated along with the impeller.

8. A dishwasher, comprising:

a sump having a bottom wall;

a pump housing forming a pumping chamber having an inlet in fluid communication with the sump and an outlet, a motor drive shaft extending into the pumping chamber;

an impeller connected to the motor drive shaft for rotation within the pumping chamber;

a particle screen supported upstream of the impeller;

a chopping blade rotatably supported on the particle screen and detachably coupled to the impeller for co-rotation therewith; and an inlet shroud for forming the inlet area, the particle chopping assembly being captured between the inlet shroud and the bottom wall of the sump.

9. A dishwasher, comprising:

a wash chamber including a sump;

a pump having a rotating element supported by a motor drive shaft within a pump housing, the pump adapted to draw liquid from the sump through an inlet area and then pump liquid to the wash chamber;

a particle chopping assembly supported in the inlet area upstream of the rotating element, the particle chopping assembly including a particle screen, a chopping blade and a drive shaft rotatably mounted on the particle screen, said drive shaft drivingly supporting the chopping blade and having a coupling end which detachably couples to the rotating element.

10. The dishwasher according to claim 9, wherein the coupling between the chopping blade and the rotating element is capable of accommodating axial tolerance with regard to the axial position of the rotating element.

11. The dishwasher according to claim 9 wherein the rotating element includes a drive extension which detachably couples to the coupling end of the drive shaft.

12. The dishwasher according to claim 11, wherein the coupling end includes a plurality of teeth and a centering hole and the drive extension includes a plurality of teeth and a center pin, the centering hole receiving the center pin and the teeth of the coupling end and the teeth of the drive extension engaging each other to drivingly couple the drive shaft to the rotating element, and the teeth of the coupling end and the teeth of the drive extension over lap each other to accommodate axial tolerance the axial position of the impeller.

13. The dishwasher according to claim 9, further wherein the particle chopping assembly further comprises:

the particle screen having a center opening provided with a bearing having a first bearing surface and an opposite second bearing surface, and a drive shaft rotatably supported on the particle screen, the drive shaft having a first end extending through the center opening of the particle screen wherein the chopping blade is mounted to the first end of the drive shaft and is biased against the first bearing surface, the drive shaft further having a coupling end which detachably couples to the rotating element.

14. The dishwasher according to claim 9, further wherein the particle chopping assembly comprises:

the particle screen having a center opening provided with a bearing having a first bearing surface and an opposite second bearing surface, a drive shaft having a first end extending through the center opening of the particle screen, the drive shaft further having a coupling end including a shoulder, the coupling end detachably couples to the impeller;

a fastener for securing the chopping blade onto the first end Of the drive shaft such that the chopping blade is drivingly supported on the drive shaft and seats on the first bearing surface;

a washer disposed about the drive shaft adjacent the second bearing surface; and a spring disposed about the drive shaft and captured between the shoulder and the washer such that chopping blade is biased toward the particle screen.

15. The dishwasher according to claim 9, wherein the chopping blade further comprises:

a reverse angle portion which directs wash liquid upstream, away from the particle screen when the chopping blade is rotated along with the impeller.

16. A method for assembling a dishwasher which includes a sump, the method comprising the steps of:

assembling a chopping assembly including a particle screen, a drive shaft and a chopping blade wherein the drive shaft driving supports the chopping blade and is rotatably mounted to the particle screen;

securing the chopping assembly within the sump; and connecting a pump assembly including a motor and impeller mounted on the motor drive shaft to the sump, wherein a drive extension of the impeller is drivingly coupled to the chopping assembly.

17. The method of assembling a dishwasher according to claim 16, wherein the step of assembly the chopping assembly further comprises the steps of.

inserting a first end of the drive shaft a center opening of the particle screen which is provided with a bearing having a first bearing surface and an opposite second bearing surface, securing the chopping blade onto the first end of the drive shaft with a fastener such that the chopping blade is drivingly supported on the drive shaft and seats on the first bearing surface;

capturing a washer and spring disposed about the drive shaft between the second bearing surface and a shoulder provided on the drive shaft such that the chopping blade is biased toward the particle screen.

18. The method of assembling a dishwasher according to claim 16, wherein the step of assembly the chopping assembly further comprises the steps of:

molding a bearing about the center opening of the particle screen.

19. The method of assembling a dishwasher according to claim 16, wherein the chopping assembly is inserted into the sump before the pump assembly is connected to the sump.

20. The method of assembling a dishwasher according to claim 18 wherein the pump assembly is connected to the sump before the chopping assembly is inserted into the sump.

21. A dishwasher, comprising:

a sump;

a pump housing forming a pumping chamber having an inlet in fluid communication with the sump and an outlet, a motor drive shaft extending into the pumping chamber;

an impeller connected to the motor drive shaft for rotation within the pumping chamber during a recirculating period;

a particle screen supported upstream of the impeller, said particle screen having a center opening provided with a bearing having a first bearing surface and an opposite second bearing surface, and a drive shaft rotatably supported on the particle screen, the drive shaft having a first end extending through the center opening of the particle screen; and a chopping blade rotatably supported upstream of the particle screen, the chopping blade including a reverse angle portion which directs wash liquid upstream, away from the particle screen when the chopping blade is rotated during the recirculating period wherein the chopping blade is mounted to the first end of the drive shart and is biased against the first bearing surface, the drive shaft further having a coupling end which detachably couples to the impeller.

22. The dishwasher according to claim 21, wherein said drive shaft rotatably and driving supports the chopping blade within 2mm or less of the particle screen.

23. The dishwasher according to claim, 21, wherein the coupling between the chopping blade and the impelier is capable of accommodating axial tolerance between the coupling end of the driving shaft and the impeller.

24. The dishwasher according to claim 21, wherein the impeller includes a drive extension which detachable couples to the coupling end of the drive shaft.

* * * * *